US006618908B1

(12) United States Patent
Lamb

(10) Patent No.: US 6,618,908 B1
(45) Date of Patent: Sep. 16, 2003

(54) CUFFLINK FOR A CASUAL SHIRT

(76) Inventor: Brooks Lamb, 3200 Park Center Dr., Team 2, Costa Mesa, CA (US) 92626

( * ) Notice: Subject to any disclaimer, the term of this patent is extended or adjusted under 35 U.S.C. 154(b) by 0 days.

(21) Appl. No.: 10/090,030

(22) Filed: Mar. 5, 2002

(51) Int. Cl.[7] ..... A44B 5/00

(52) U.S. Cl. ..... 24/41.1; 24/114.11; 24/97; 24/547; D11/222

(58) Field of Search ..... 24/41.1, 90.1, 24/101 R, 101 B, 910, 97, 114.9, 114.11, 547, 16 PB, 30.5 P; D11/222; 40/302; 63/DIG. 3, 14.1, 14.2, 14.3, 14.4, 14.5, 14.8

(56) References Cited

U.S. PATENT DOCUMENTS

| | | | | | |
|---|---|---|---|---|---|
| 249,293 | A | * | 11/1881 | Blinn | 24/598.1 |
| 904,437 | A | * | 11/1908 | Heynemann | 24/97 |
| 2,535,139 | A | * | 12/1950 | Kanarek | 24/102 FC |
| 2,585,181 | A | * | 2/1952 | Stavropoulos et al. | 24/97 |
| 2,611,251 | A | * | 9/1952 | Guth | 63/14.8 |
| 2,983,980 | A | * | 5/1961 | Hamel | 24/581.12 |
| 3,670,524 | A | | 6/1972 | Korwin | |
| 4,062,089 | A | | 12/1977 | Vinczer | |
| 4,242,776 | A | | 1/1981 | Kurashima | |
| 4,308,637 | A | * | 1/1982 | Kucera | 16/93 D |
| 4,361,936 | A | | 12/1982 | Kurashima | |
| 4,441,234 | A | | 4/1984 | Kurashima | |
| 4,566,155 | A | | 1/1986 | Kurashima | |
| 5,367,742 | A | * | 11/1994 | Bindman | 16/87.2 |
| D366,013 | S | | 1/1996 | Pandel | |
| 5,490,309 | A | | 2/1996 | Velasquez | |
| 5,497,537 | A | * | 3/1996 | Robinson et al. | 24/716 |
| 5,806,141 | A | * | 9/1998 | Kolisch | 16/87.2 |
| D415,068 | S | | 10/1999 | Calvani | |

* cited by examiner

*Primary Examiner*—Robert J. Sandy
(74) *Attorney, Agent, or Firm*—Vladimir Khiterer

(57) ABSTRACT

This invention relates to a cufflink that can be attached on a casual shirt of a type comprising a cuff, a cuff button and only one cuff button hole. The cufflink comprises a pair of legs joined by a spring, an attachment means, which is either a hook or a cup-shaped member for placing on top of the cuff button and an impingement knob biased against the attachment means by the spring.

3 Claims, 2 Drawing Sheets

CUFFLINK FOR A CASUAL SHIRT

FIELD OF THE INVENTION

This invention relates to a cufflink comprising a pair of legs joined by a spring means, an attachment means and an impingement knob biased against the attachment means by the spring means, such that the cufflink can be worn with a casual shirt of a type comprising a cuff, a cuff button and a cuff button hole.

BACKGROUND OF THE INVENTION

Prior known cufflinks comprise a decorative member and a link member integrally formed as a protrusion from the former, and said link member has an engagement piece which can be alternatively disposed in two positions i.e. it may elongate in the axial direction and at a right angle to the longitudinal axis of the shank of the link. In operation, first, said link is inserted through two button holes of the shirt's cuff with its engagement piece in its elongated state; secondly, said engagement piece is rotated toward a direction at a right angle with respect to an axial line of said link member, so that the cufflink is secured through the two button holes of the shirt's cuff.

The shortcoming of the cufflinks of the prior art is that they require two button holes disposed on the shirt's cuff, i.e. either the so called "convertible cuff" equipped with two button holes and a button sewn on the cuff, or the so called "double folded cuff" equipped with two button holes and no button. The prior art cufflinks cannot be worn with a casual shirt of a type comprising a cuff, a cuff button and only one cuff button hole.

SUMMARY OF THE INVENTION

This invention overcomes the drawbacks in the prior art and provides a cufflink comprising a pair of legs joined by a spring means, an attachment means and an impingement knob biased against the attachment means by the spring means. The cuff link can be attached on a casual shirt of a type comprising a cuff, a cuff button and only one cuff button hole by inserting the impingement knob through the cuff button hole, attaching the attachment means to the cuff button and thus causing the impingement knob to stay in a position inserted through the cuff button hole by way of the force supplied by the spring means biasing the impingement knob against the attachment means. The attachment means can be a hook-shaped member for placing between the cuff button and the cuff or a cup-shaped member for placing on top of the cuff button that includes a recess for receiving and engagement by way of the force of friction with the cuff button.

BRIEF DESCRIPTION OF THE DRAWINGS FIGURES

DETAILED DESCRIPTION OF THE PREFERRED EMBODIMENTS

Figure 2:
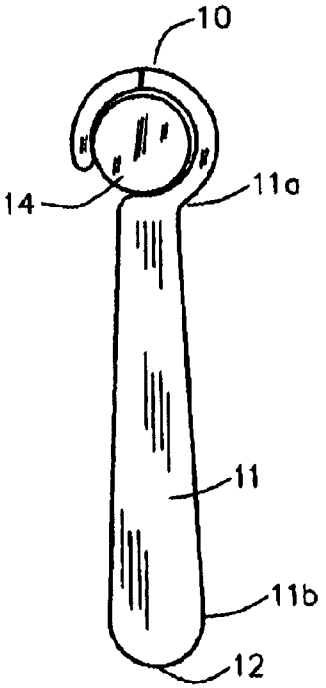
FIG. 2 shows a side elevation of the first embodiment of this invention.

This invention will be better understood with the reference to the drawing figures FIG. 1 through FIG. 4. The same numerals and letters refer to the same elements in all drawing figures.

Figure 1:
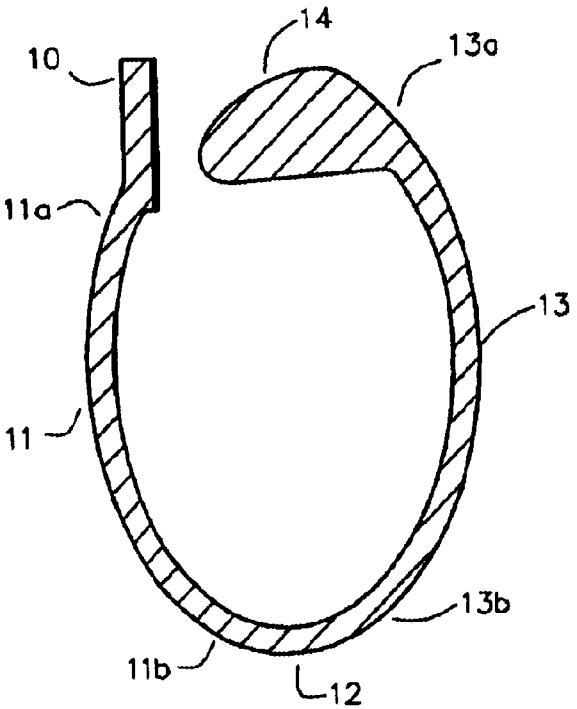
FIG. 1 shows a longitudinal cross section of a first embodiment of this invention.

Viewing both FIG. 1 and FIG. 2, there is shown the first embodiment of this invention. Numeral 10 indicates an attachment means; numeral 11 indicates a first leg; numeral 13 indicates a second leg. First Leg 11 comprises a proximal end indicated by numeral 11*a* and a distal end indicated by numeral 11*b*. Attachment Means 10 is disposed on Proximal End 11*a*. Further, Attachment Means 10 is shown in FIG. 1 and FIG. 2 as a hook-shaped member having a plane substantially perpendicular to the plane formed by First Leg 11 and Second Leg 13.

Second Leg 13 comprises a first end indicated by numeral 13*a* and a second end indicated by numeral 13*b*. Distal End 11*b* and Second End 13*b* are joined by a spring means indicated by numeral 12. First Leg 11, Spring Means 12 and Second Leg 13 are formed from one continuous piece of material. It is well known in the pertinent arts that articles of jewelry are traditionally made of gold, silver, platinum, steel and other metals, as well as various alloys (see Kegulian, U.S. Pat. No. 5,952,113). Unitary articles of jewelry (i.e. articles of jewelry comprising one piece of material) can be made by way of, among other things, investment casting, as described in detail in Kegulian, U.S. Pat. No. 5,952,113. Numeral 14 indicates an impingement knob. Impingement Knob 14 is disposed on First End 13*a*.

First Leg 11 and Second Leg 13 are lying generally in a common plane. Spring Means 12 causes Proximal End 11*a* to bias against First End 13*a*.

In order to use the cufflink of the present invention, Attachment Means 10 is hooked on the cuff button by slidingly placing it between the cuff button and the cuff; Impingement Knob 14 is inserted through the cuff button hole such that Attachment Means 10 and Impingement Knob 14 are urged to bias each other by respectively Proximal End 11*a* and First End 13*a*, causing Impingement Knob 14 to stay in a position inserted through the cuff button hole.

Figure 4:
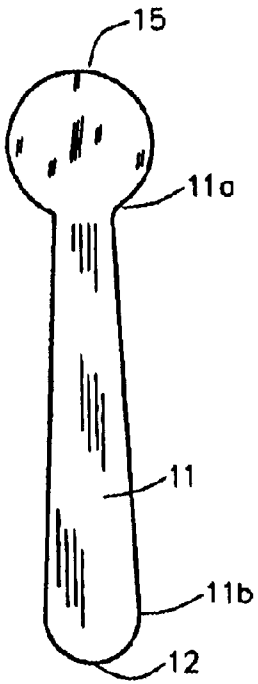
FIG. 4 shows a side elevation of the second embodiment of this invention.
Figure 3:
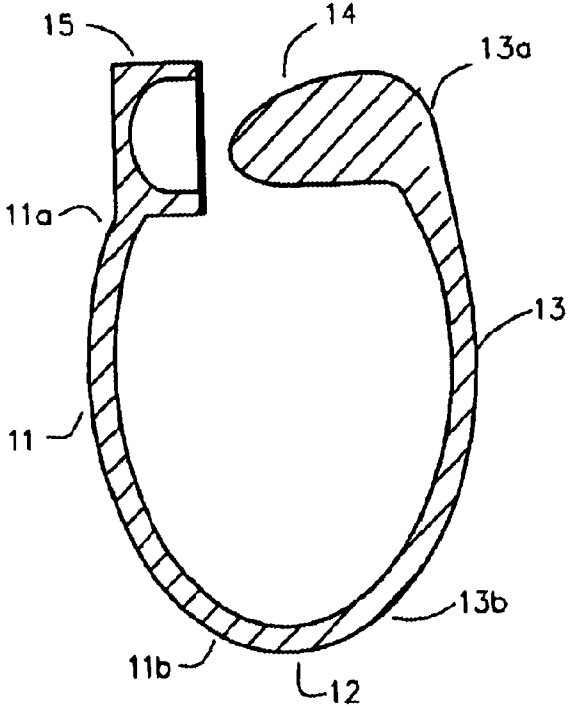
FIG. 3 shows a longitudinal cross section of a second embodiment of this invention.

Viewing now FIG. 3 and FIG. 4, there is shown the third embodiment of this invention, which is identical, in all respects to the embodiment shown in FIG. 1 and FIG. 2, except the attachment means is indicated by numeral "16". Attachment Means 15 is shown in FIG. 3 and FIG. 4 as a cup-shaped member which includes a recess constructed and arranged for receiving and engagement by way of the force of friction with the cuff button.

In order to use the cufflink of the embodiment shown in FIG. 3 and FIG. 4, Attachment Means 15 is placed on top of the cuff button, causing it to engage by way of the force of friction with the cuff button; Impingement Knob 14 is inserted through the cuff button hole such that Attachment Means 15 and Impingement Knob 14 are urged to bias each other by respectively Proximal End 11*a* and First End 13*a*, causing Impingement Knob 14 to stay in a position inserted through the cuff button hole.

It should be noted that any combination of Attachment Means 15, Attachment Means 10, Spring Means 12 and Spring Means 15 can be used. Further, being an item of personal adornment, a number of decorative members, such as precious stones and the like, can be disposed anywhere on First Leg 11, Second Leg 13, Attachment Means 15, Attachment Means 10 and Impingement Knob 14.

While the present invention has been described and defined by reference to the preferred embodiment of the invention, such reference does not imply a limitation on the invention, and no such limitation is to be inferred. The invention is capable of considerable modification, alteration, and equivalents in form and function, as will occur to those ordinarily skilled and knowledgeable in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

What is claimed is:

1. A cufflink for a casual shirt of a type comprising a cuff, a cuff button and a cuff button hole, comprising:

(a) A first leg comprising a proximal end and a distal end;

(b) a second leg comprising a first end and a second end, said first leg and said second leg lying generally in a common plane, said distal end and said second end joined by a spring means such that said proximal end is urged to bias said first end, wherein the first leg, the spring means and the second leg are formed from one continuous piece of elastic material;

(c) an attachment means disposed on said proximal end for attachment to the cuff button;

(d) an impingement knob disposed on said first end for inserting through the cuff button hole such that said attachment means and said impingement knob are urged to bias each other by respectively said proximal end and said first end, causing said impingement knob to stay in a position inserted through the cuff button hole.

2. A cufflink for a casual shirt as in claim 1, wherein said attachment means is a hook-shaped member for slidingly placing between the cuff button and the cuff, said hook-shaped member having a plane substantially perpendicular to the plane formed by said first leg and said second leg.

3. A cufflink for a casual shirt as in claim 1, wherein said attachment means is a cup-shaped member for placing on top of the cuff button, said cup-shaped member includes a recess constructed and arranged for receiving and engagement by way of the force of friction with the cuff button.

* * * * *